US007726653B2

(12) United States Patent
Durbin

(10) Patent No.: US 7,726,653 B2
(45) **Date of Patent: *Jun. 1, 2010**

(54) METHOD OF PLAYING A CARD GAME

(76) Inventor: Joseph V. Durbin, 5618 Grandel Blvd., Louisville, KY (US) 40258

( * ) Notice: Subject to any disclaimer, the term of this patent is extended or adjusted under 35 U.S.C. 154(b) by 139 days.

This patent is subject to a terminal disclaimer.

(21) Appl. No.: 11/980,973

(22) Filed: Oct. 31, 2007

(65) Prior Publication Data

US 2008/0061507 A1 Mar. 13, 2008

Related U.S. Application Data

(63) Continuation-in-part of application No. 11/111,391, filed on Apr. 21, 2005, now Pat. No. 7,249,765, and a continuation-in-part of application No. 11/881,914, filed on Jul. 30, 2007, now abandoned.

(51) Int. Cl.
*A63F 1/00* (2006.01)

(52) U.S. Cl. ..... 273/274; 273/292

(58) Field of Classification Search ..... 273/274, 273/292, 309; 463/13

See application file for complete search history.

(56) References Cited

U.S. PATENT DOCUMENTS 5,799,945 A * 9/1998 Boylan et al. ..... 273/292
5,839,732 A * 11/1998 Guidi ..... 273/292
5,975,529 A * 11/1999 de Keller ..... 273/292
6,070,873 A * 6/2000 Perkins ..... 273/292
6,234,485 B1 * 5/2001 Perkins ..... 273/292
6,299,534 B1 * 10/2001 Breeding et al. ..... 463/25
6,517,072 B1 2/2003 McInerney
6,575,467 B1 * 6/2003 Kal ..... 273/292
6,698,759 B2 * 3/2004 Webb et al. ..... 273/292
6,719,292 B2 * 4/2004 Lo ..... 273/292
6,752,395 B2 * 6/2004 Jones et al. ..... 273/292
6,840,517 B2 * 1/2005 Snow et al. ..... 273/292
6,938,482 B2 9/2005 Schultz
6,938,900 B2 * 9/2005 Snow ..... 273/292
6,959,928 B2 * 11/2005 Schultz ..... 273/292
7,004,467 B2 * 2/2006 Lo ..... 273/292
7,036,822 B2 * 5/2006 O'Grady ..... 273/292
7,044,468 B2 * 5/2006 Sklansky et al. ..... 273/292
7,165,770 B2 * 1/2007 Snow ..... 273/292

* cited by examiner

*Primary Examiner*—William M Pierce
(74) *Attorney, Agent, or Firm*—James C. Eaves, Jr.; Greenebaum Doll & McDonald PLLC

(57) ABSTRACT

The present invention preferably relates to a casino card game played with a standard fifty-two card deck. The game is divided into a bonus round, progressive bonus round, and a challenge round. Each player places an ante and a bonus wager and, if desired, an optional progressive bonus wager at the start of the game and must place an additional wager to continue into the challenge round. The dealer pays winning hands at three points in the game, at the end of the bonus round, at the end of the progressive bonus round, and at the end of the challenge round. The bonus round is paid according to each player's two card hand plus a third (bonus) community card. The progressive bonus round is paid according to each player's two card hand plus a third (bonus) and fourth (progressive bonus) community card. The challenge round is played one-on-one with each player two card hand versus the dealer's. The player has the option to buy a new card and surrender a card of his choice during the challenge round for a predetermined price.

22 Claims, 4 Drawing Sheets

BONUS PAYS:
PAIR 1:1
FLUSH 3:1
STRAIGHT 5:1
3 OF A KIND 40:1
STRAIGHT FLUSH 50:1
2 RED ACES WITH BLACK BONUS ACE 200:1

PROGRESSIVE BONUS PAYS:
2 RED ACES WITH BLACK BONUS ACE AND BLACK PROGRESSIVE ACE : 100% OF PROGRESSIVE JACKPOT
FOUR OF A KIND: 10% OF PROGRESSIVE JACKPOT
FOUR CARD STRAIGHT FLUSH: $500

CHALLENGE PAYS:
WINNING PAIRS 2:1

METHOD OF PLAYING A CARD GAME

This application is a continuation-in-part of application Ser. No. 11/111,391, filed Apr. 21, 2005, now U.S. Pat. No. 7,249,765, for a Method of Playing a Card Game of Joseph V. Durbin, incorporated herein by reference; and a continuation-in-part of application Ser. No. 11/881,914, filed Jul. 30, 2007, now abandoned for a Method of Playing a Card Game of Joseph V. Durbin, incorporated herein by reference.

BACKGROUND OF THE INVENTION (a) Field of the Invention

The present invention relates to a card game which can be played with a physical standard deck of cards or electronically. It is a wagering game preferably played in a casino environment. The game involves multiple wagers and three playing segments, the segments being a bonus round, an optional progressive bonus round, and a challenge round.

(b) Description of the Prior Art

Many different wagering games involving cards are played by individuals. These games may involve the individuals playing individually against a dealer or against each other. For example, in the game black jack or 21, each player plays against a dealer's hand. All players at a table can win if they individually beat the dealer's hand without going bust or having their cards add up to more than 21. In many poker type games, the players at a table are generally playing against all of the other players at the table with only one player winning each hand.

These wagering games can be played using one or more standard decks of cards, normally a 52 card deck with 13 cards in each of four suits (clubs, diamonds, hearts, and spades), the 13 cards being cards numbered 2-10, plus a jack, queen, king, and ace. Some of the games involve one or more additional cards, generally referred to as a joker or wild card.

Further, these games can be played using actual cards or electronically. Electronic card wagering games can involve a machine, such as a video poker machine, where an individual is playing against that machine, or a computer where an individual may access a virtual casino over the internet and play similar to a video poker machine or play against a virtual or real dealer or against other individuals connected to the same virtual casino.

SUMMARY OF THE INVENTION

The present invention relates to a card game that, for example, may be played as a casino card game with a dealer and one or more players, on a computerized gaming machine, in homes, or on the internet. The game is preferably played with a standard fifty-two card playing card deck. The game is divided into three playing segments, a bonus round, a progressive bonus round, and a challenge round. The player places two or three wagers at the start of the game. An ante and a bonus wager must be made and the player has the option of placing a progressive bonus wager. The player must place an additional wager to continue into the challenge round. In the preferred embodiment, a player may still pay the challenge round wager and participate in the challenge round regardless of whether he has participated in the progressive bonus round by placing a progressive bonus wager. However, participation in the challenge round may be predicated upon participation in the progressive bonus round without departing from the spirit of this invention. The dealer pays winning hands at the following points in the game: once at the end of the bonus round, once at the end of the progressive bonus round, and once at the end of the challenge round. The bonus round is paid according to each player's two card hand plus a third community card, for predetermined winning card combinations at predetermined odds. The progressive bonus round is paid according to each player's two card hand plus the bonus card and progressive bonus card, which are community cards, for predetermined winning card combinations at predetermined odds. The challenge round is played one-on-one with each player versus the dealer. The player has the option to buy a new card and surrender a card of his choice during the challenge round for a predetermined price. If the player has the winning two card combination versus the dealer, the player is paid at the conclusion of the challenge round based on predetermined odds.

While the game may be played in many forms, the preferred embodiment of the invention is played in a casino at a playing table with a dealer and up to seven players, and will be discussed in detail as such.

More specifically, the present invention is for a method of playing a card game, comprising:

a. at least one player making an ante wager and a bonus wager and, if desired, an optional progressive bonus wager to initiate a game;

b. a dealer sequentially dealing the at least one player and the dealer a first card and a second card;

c. the dealer dealing a bonus card and a progressive bonus card;

d. the at least one player viewing that player's first card and second card;

e. the at least one player deciding whether to challenge the dealer, the at least one player making a challenge ante wager if the at least one player decides to challenge the dealer;

f. the dealer revealing the bonus card to the at least one player if the bonus card was dealt face down;

g. the dealer paying the at least one player if that player's first card and second card and the bonus card meet a bonus combination specified on a bonus payment table and the dealer taking the bonus wager of the at least one player if that player's first card and second card and the bonus card do not meet the bonus combination specified on the bonus payment table;

h. the dealer revealing the progressive bonus, card to the at least one player if the progressive bonus card was dealt face down;

i. the dealer paying the at least one player if that player made a progressive bonus wager and that player's first card, second card, bonus card and the progressive bonus card meet a progressive bonus combination specified on a progressive bonus payment table and the dealer taking the progressive bonus wager of the at least one player if that player's first card, second card, bonus card, and the progressive bonus card do not meet the progressive bonus combination specified on the progressive bonus payment table;

j. the dealer taking the ante wager of the at least one player not making the challenge ante wager;

k. the dealer offering the at least one player the option of making a buy wager and replacing either of the player's first card or second card and, if the player makes the buy wager and surrenders either the first card or the second card, dealing the player a replacement card, the at least one player now having a two card hand, this being an optional step in the game;

l. the dealer revealing the dealer's first card and second card;

m. the dealer replacing one of the dealer's first card and second card having a lowest face value if one of the dealer's first card and second card is not a jack, a queen, a king, or an ace or if the dealer's first card and second card are not cards of the same face value; the dealer now having a dealer two card hand;

n. the dealer paying the at least one player on the ante wager and on the challenge ante wager if that player's two card hand is a better poker hand than the dealer two card hand, the dealer taking the ante wager and the challenge ante wager of the at least one player if the dealer two card hand is a better poker hand than the player's two card hand, the at least one player keeping the ante wager and the challenge ante wager if the dealer two card hand and the player's two card hand are poker hands of the same value.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
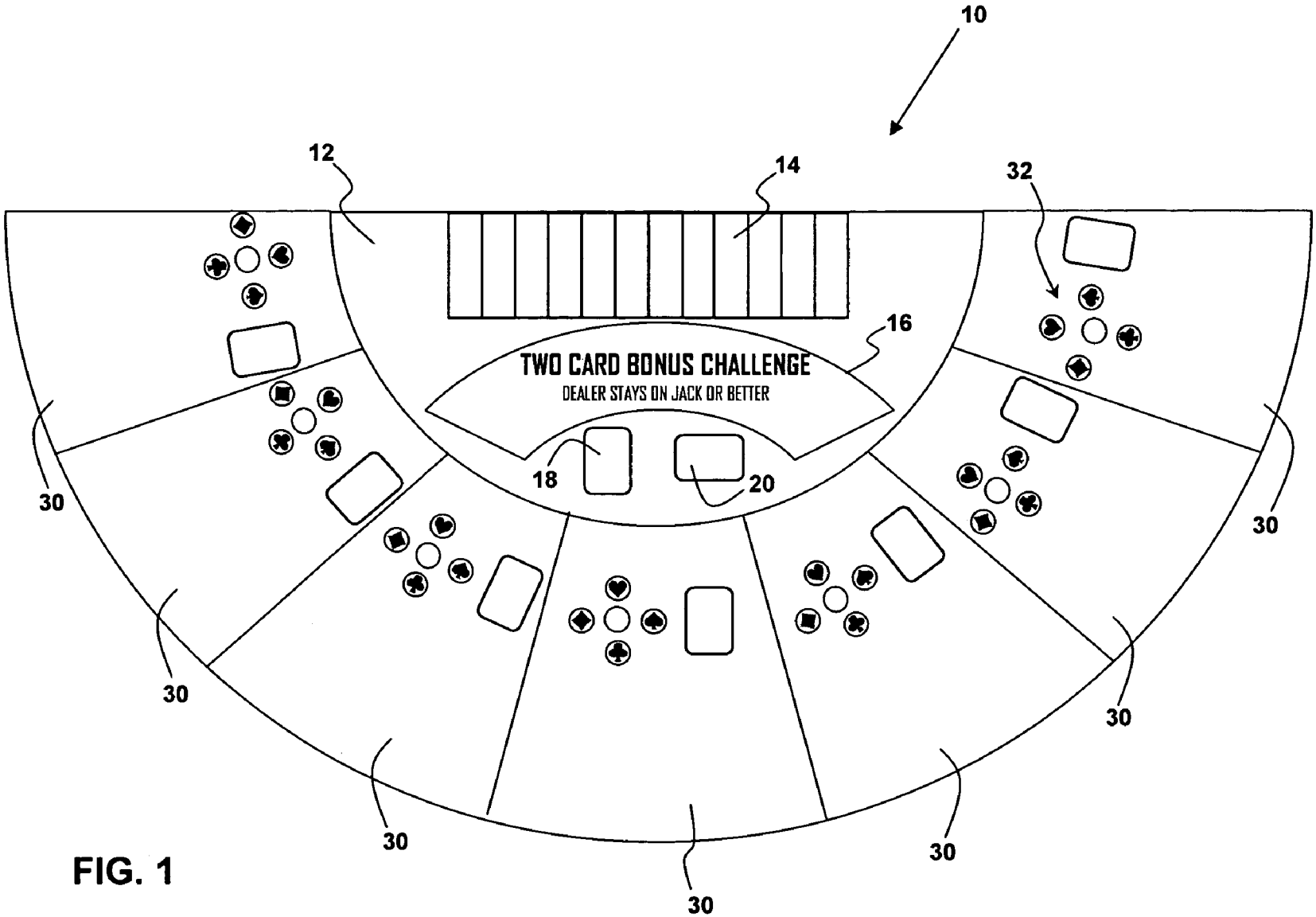
FIG. 1 shows a playing table containing seven player areas, and a dealer area containing designated areas for chips, the dealer hand, and the first and progressive bonus cards.
Figure 2:
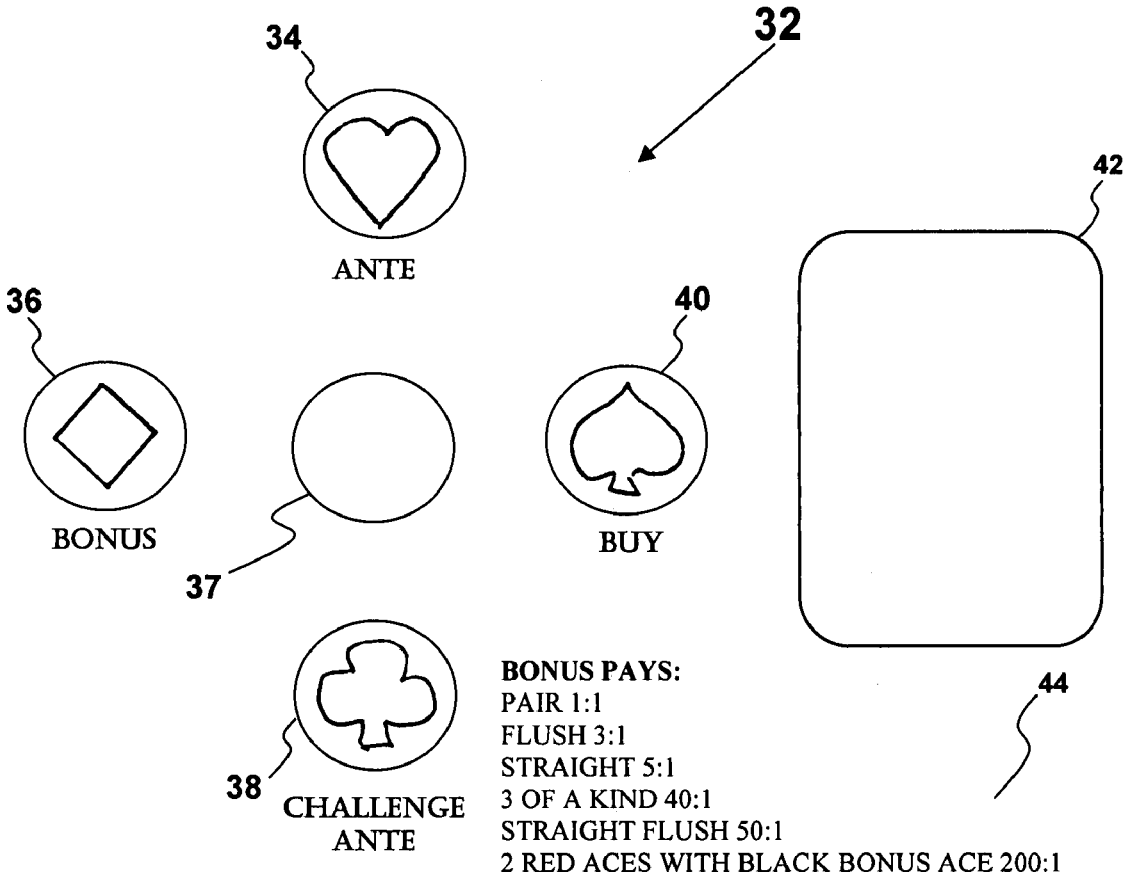
FIG. 2 shows the detail of a portion of one of the seven player areas shown in FIG. 1, the portion of the player area containing designated areas for the four wagers (Ante, Bonus, Progressive Bonus, and Challenge Ante), and a designated Buy area for the Buy-Card payment. The player's area also contains a designated area for the player's dealt cards.
Figure 3A:
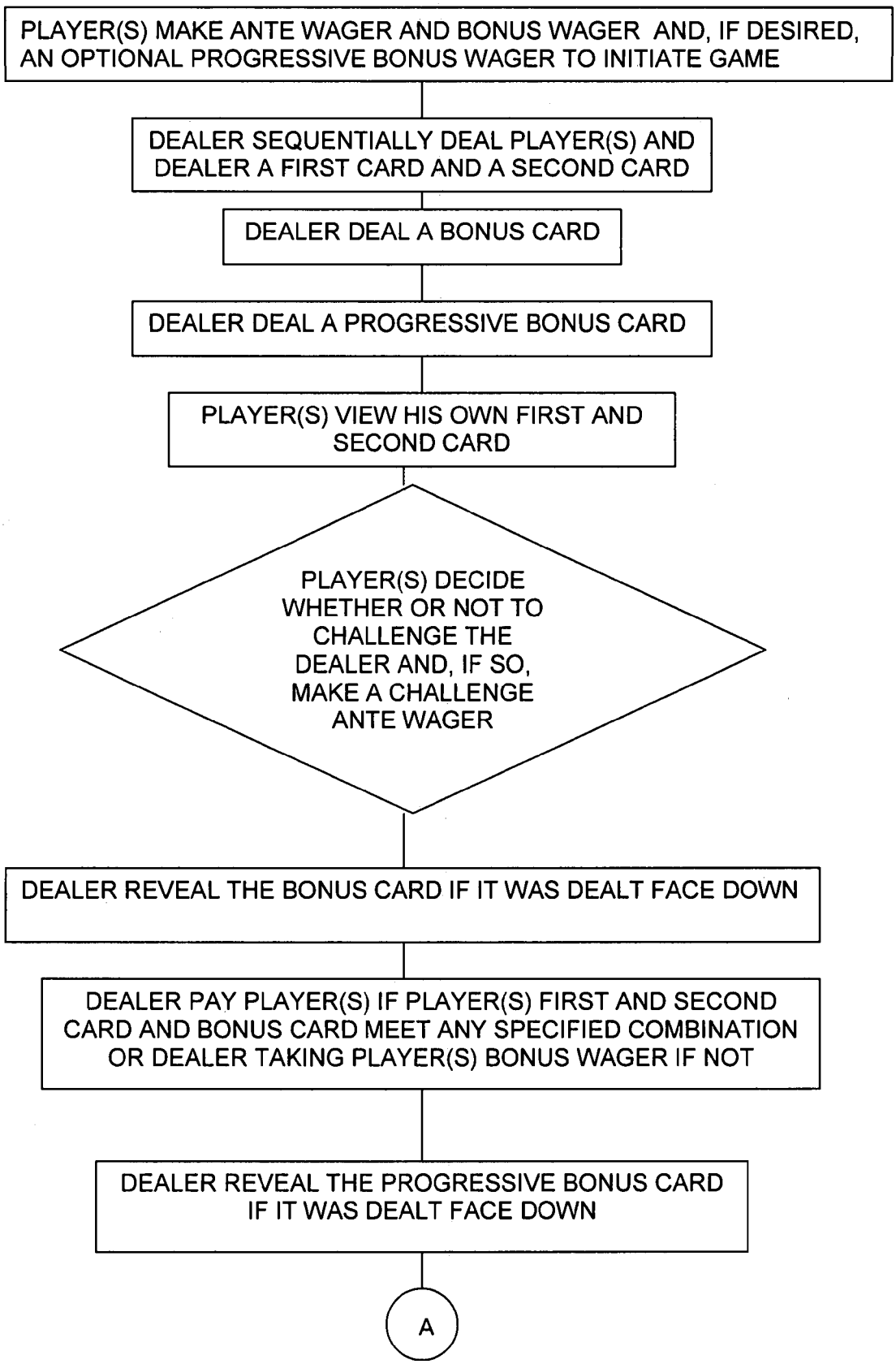
FIGS. 3A and 3B show the method of playing the card game of the present invention, the boxes with dashed lines being optional features of the game.

With reference to FIGS. 1-3A/3B, FIG. 1 shows a table 10 where the card game of the instant invention could be played, for example, at a casino. Table 10 includes a dealer area 12 and a plurality of individual player areas 30. The top of the table 10 is usually a felt material having printing thereon. As shown, this table has seven player areas 30. FIG. 2 shows expanded detail of a portion 32 of a player area 30. FIGS. 3A and 3B show the method of playing the card game.

FIG. 1 shows that the dealer area 12 includes a location 14 where the dealer keeps chips. As shown, and as is typical in the casino environment, the dealer has available a plurality of different colored chips, for example, white, pink, red, green, black, and purple, each different colored chip having a different monetary value.

The dealer area 12 also includes a game area 16, a dealer hand area 18, and a bonus card area 20. The game area 16 includes a game identifying logo: "TWO CARD BONUS CHALLENGE" and an explanation that the dealer stays on jack or better. This game area 16 is typically printed on the felt in an orientation facing the player area. The dealer hand area 18 is simply the marked area on the felt where the dealer will place the dealer's cards and the bonus card area 20 is simply the marked area on the felt where the dealer will place the bonus card and the progressive bonus card. If desired, separate areas can be identified for the bonus card and the progressive bonus card.

As previously stated, table 10 is shown in FIG. 1 having player areas 30. Table 10 shows that up to seven individual players can play at this table. Each player area 30 has a felt marked area portion 32. As seen in FIG. 1, this portion 32 is located toward the dealer area 12 within each player area 30. Portion 32 contains an ante area 34, shown as a printed circle having a heart symbol therein with the word ante below the circle; a bonus area 36, shown as a printed circle having a diamond symbol therein with the word bonus below the circle; a progressive bonus area 37, shown as a printed circle with the words progressive bonus below the circle; a challenge ante area 38, shown as a printed circle having a club symbol therein with the words challenge ante below the circle; and, a buy area 40, shown as a printed circle having a spade symbol therein with the word buy below the circle. To the right of the areas 34, 36, 37, 38, and 40 is a marked generally rectangular area 42. This area 42 is the marked area for the dealer to place that player's cards. Below the area 42 is an area 44 where the player payouts for the game are listed.

For example, as shown, the payment table for the bonus segment of the game shows that the dealer pays 1 to 1 for a pair, 3 to 1 for a flush, 5 to 1 for a straight, 40 to 1 for three of a kind, 50 to 1 for a straight flush, and 200 to 1 for two red aces if the bonus card is one of the two black aces.

Also, as shown, for the progressive bonus segment of the game shows that the player will receive 100% of the progressive jackpot if he has two red aces, and both bonus card and progressive bonus card are black aces; the player will receive 10% of the progressive jackpot if his two cards, the bonus card and progressive bonus card are all of the same rank, forming the combination known in poker as "four of a kind"; and the player will receive $500 if his two cards in any combination with the bonus card, and progressive bonus card, are all of the same suit and in sequence, forming the combination known in poker as a "four card straight flush".

Shown for the challenge segment of the game, the challenge ante wager in 38 is paid 2 to 1 by the dealer for a winning pair.

The above description of the game table 10 is only one example of a layout which could be used in a casino setting for efficient play of the game of the instant invention. The above payouts are the preferred embodiment. However, these payouts may be changed without departing from the spirit of the present invention.

Figure 3B:
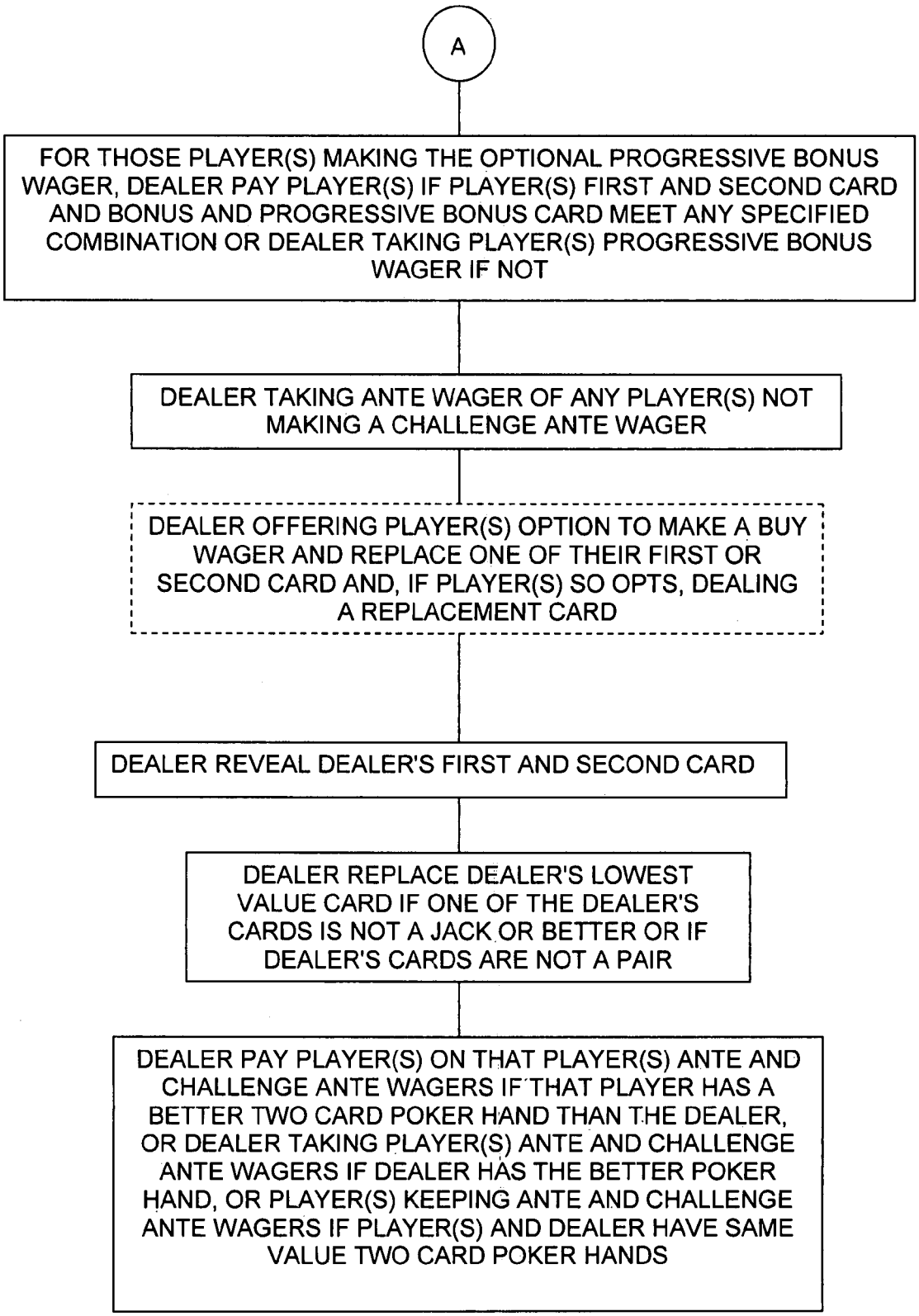

The game of the instant invention is played with a standard fifty-two card playing deck and incorporates traditional poker card rankings with aces being high. The method of playing is shown in FIGS. 3A and 3B. To begin, a player must make two or three separate wagers. Required wagers are an Ante, placed in the ante area 34 in that player's area 30, and a Bonus wager, placed in the bonus area 36 in that player's area 30. A progressive bonus wager, placed in area 37 in that player's area 30 may optionally be made by the player at the start of the game. The Ante, Bonus, and Progressive Bonus wagers need not be the same amount, but each wager must be at least the house-set table minimum. The preferred progressive bonus wager amount is $1. Each player and dealer will receive two cards dealt face down one at a time. The dealer will place the cards for each player at that player's area 42 and will place the dealer cards at dealer hand area 18. After all players (up to seven) and the dealer have received their two cards, the next two cards off the deck (the bonus card and the progressive bonus card) are placed face down into a designated Bonus Card area 20 on the playing table 10. The dealer then allows each player to view that player's two card hand. After viewing their two card hand, each player must decide at this time whether or not he or she is going to challenge the dealer's undisclosed two card hand by placing a separate wager in a specified Challenge Ante area 38 on the playing table 10. The house sets the amount of the Challenge Ante Wager. Preferably this should be a value of from equal to the ante wager to 1.5 times the ante wager. Most preferably, the ante wager and challenge on the wager should be of the same value. Changing this value will affect the game payout. After all Challenge Antes have been placed by any player desiring to challenge, the cards are then placed by all players face down in a designated area 42 on the playing table 10. Now the dealer will reveal the bonus card in area 20, which is a community card for all players to be combined with each player's two cards to make a bonus hand of three cards.

For example, if a player is dealt two Fives, and the bonus card is a Five, the player now has three Fives (three of a kind) for the bonus round or bonus segment. As shown in area 44 of each player area 30, the bonus round is paid according to the following odds applied to the player's Bonus wager (ratio of payoff:player's Bonus wager): Pair 1:1, Flush 3:1, Straight 5:1, Three of a Kind 40:1, Straight Flush 50:1, Player holds two red aces and bonus card is black ace 200:1. It is noted that in the bonus segment each player is not playing against the dealer or other players. After showing the bonus card, the dealer will turn over each player's two cards and simply pay each player if their two cards and the bonus card meet the requirements for one of the above payouts. If, among a player's two cards and the bonus card, that player does not have at least a pair, that player loses the bonus segment and the amount that player placed in the bonus area 36. It is also noted that the bonus card in area 20 is only used in the game for the bonus and progressive bonus segments. The bonus card and the progressive bonus card are not used for the challenge segment.

The dealer pays each winning player according to the above odds and collects all non-winning Bonus wagers from area 36 of each non-winning player.

After the bonus segment, the progressive bonus segment follows for all players who made a progressive bonus wager. The dealer will reveal the progressive bonus card. The progressive bonus card is another community card for all players to be combined with the bonus card and each player's two cards to make a progressive bonus hand of four cards.

For example, if a player is dealt two Fives, and the bonus and progressive bonus cards are both Fives, the player now has four Fives (four of a kind) for the progressive bonus round or progressive bonus segment. As shown in area 44 of each player area 30, the bonus round is paid according to the following schedule: the player will receive 100% of the progressive jackpot if he has two red aces, and both bonus card and progressive bonus-card are black aces; the player will receive 10% of the progressive jackpot if his two cards, the bonus card and progressive bonus card are all of the same rank, forming the combination known in poker as "four of a kind"; and the player will receive $500 if his two cards in any combination with the bonus card, and progressive bonus card, are all of the same suit and in sequence, forming the combination known in poker as a "four card straight flush". It is noted that in the progressive bonus segment each player is not playing against the dealer or other players. After showing the progressive bonus card, the dealer will simply pay each player if their two cards, the bonus card and progressive bonus card meet the requirements for one of the above payouts. If, among a player's two cards, bonus card and progressive bonus card, that player does not have any of the above combinations, that player loses the progressive bonus segment and the amount that player placed in the progressive bonus area 37 is collected by the dealer for increasing the progressive bonus pot.

The dealer also collects the Ante wagers from area 34 of each player who did not place a Challenge Ante wager in area 38. Any player who did not place a Challenge Ante wager in their area 38 is eliminated from continuing play of the game at this point.

The following Buy-Card premium is an optional feature of the game. It is preferable and a part of the best mode of practicing the game. Each player playing in the challenge segment now has the option of surrendering one of their two cards of that player's choice and purchasing one additional card for whatever amount the house sets as the Buy-Card premium. The Buy-Card premium will then be placed by players wishing to buy a card in the designated Buy area 40 on the playing table 10. The dealer then collects all Buy-Card monies from the areas 40 at the time of providing a replacement card for the surrendered card. The player must surrender one of his or her two cards before being dealt the additional card, which replaces the surrendered card. The dealer will ask each player one at a time to indicate his or her surrendered card, collect each card, and then deal any new cards to replace any surrendered cards. At this point, each player at the table will have a two card hand, the dealer having the dealer's original two card hand at area 18.

For example, if a player's original two card hand consists of a Four and a Jack and he or she chooses to buy a replacement card and surrender his or her Four, and if he is then dealt an Ace by the dealer, the player's new two card hand consists of an Ace and a Jack.

The dealer then reveals his or her original two card hand. If the dealer's hand does not contain at least one Jack or better card, the dealer will discard his or her low card and draw a replacement card from the deck. For example, if the dealer's original two card hand consists of a Ten and a Four, the hand does not contain a Jack or better and the low card must be discarded. In this example, the Four would be discarded and replaced by one card drawn from the deck. If a Two was drawn in this example, the dealer's new two card hand would consist of a Ten and a Two. If the dealer initially has a pair, such as a pair of threes, the dealer's hand contains better than a Jack high and the dealer does not discard and draw a replacement card.

At this point in the game, each player's hand is evaluated against the dealer's hand using traditional poker rules where aces are high. The best two card hand between the dealer and each player wins. The dealer then collects all Ante wagers and Challenge Ante wagers from players with losing hands. The dealer then proceeds to pay each player with a winning hand as follows: each player with a winning hand that does not contain a pair of two cards of like face value is paid 1:1 on the Challenge Ante and 1:1 on the Ante; each player with a winning hand containing a pair of two cards of like face value is paid 2:1 on the Challenge Ante and 1:1 on the Ante. When the dealer and player hands result in a tie, the hand results in a push, where the player simply keeps his Ante and Challenge Ante wagers.

After all winning hands are paid by the dealer and all losing bets are collected, the cards are collected by the dealer and re-shuffled for the next hand. The above description has been for a table 10 used in a casino to play the described card game between a dealer and at least one player. Also, the game of the current invention can be played at locations other than in a casino. It can also be played electronically.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A method of playing a card game, comprising:

a. at least one player making an ante wager and a bonus wager and, if desired, an optional progressive bonus wager to initiate a game;

b. a dealer sequentially dealing the at least one player and the dealer a first card and a second card;

c. the dealer dealing a bonus card and a progressive bonus card;

d. the at least one player viewing that player's first card and second card;

e. the at least one player deciding whether to challenge the dealer, the at least one player making a challenge ante wager if the at least one player decides to challenge the dealer;

f. the dealer revealing the bonus card to the at least one player if the bonus card was dealt face down;

g. the dealer paying the at least one player if that player's first card and second card and the bonus card meet a bonus combination specified on a bonus payment table and the dealer taking the bonus wager of the at least one player if that player's first card and second card and the bonus card do not meet the bonus combination specified on the bonus payment table;

h. the dealer revealing the progressive bonus card to the at least one player if the progressive bonus card was dealt face down;

i. the dealer paying the at least one player if that player made a progressive bonus wager and that player's first card, second card, bonus card and the progressive bonus card meet a progressive bonus combination specified on a progressive bonus payment table and the dealer taking the progressive bonus wager of the at least one player if that player's first card, second card, bonus card, and the progressive bonus card do not meet the progressive bonus combination specified on the progressive bonus payment table;

j. the dealer taking the ante wager of the at least one player not making the challenge ante wager;

k. the dealer offering the at least one player the option of making a buy wager and replacing either of the player's first card or second card and, if the player makes the buy wager and surrenders either the first card or the second card, dealing the player a replacement card, the at least one player now having a two card hand, this being an optional step in the game;

l. the dealer revealing the dealer's first card and second card;

m. the dealer replacing one of the dealer's first card and second card having a lowest face value if one of the dealer's first card and second card is not a jack, a queen, a king, or an ace or if the dealer's first card and second card are not cards of the same face value; the dealer now having a dealer two card hand;

n. the dealer paying the at least one player on the ante wager and on the challenge ante wager if that player's two card hand is a better poker hand than the dealer two card hand, the dealer taking the ante wager and the challenge ante wager of the at least one player if the dealer two card hand is a better poker hand than the player's two card hand, the at least one player keeping the ante wager and the challenge ante wager if the dealer two card hand and the player's two card hand are poker hands of the same value.

2. The method of playing a card game of claim 1, where, in the step of said dealer paying said at least one player on said ante wager and on said challenge ante wager if that said player's two card hand is a better poker hand than said dealer two card hand, said ante wager is paid a value equal to said ante wager and said challenge ante wager is paid a value equal to said challenge ante wager unless said player's two card hand is a pair, in which case, said challenge ante wager is paid a value twice said challenge ante wager.

3. The method of playing a card game of claim 1, where said bonus payment table is:

a. a pair is paid a value equal to said bonus wager;

b. a flush is paid a value three times said bonus wager;

c. a straight is paid a value five times said bonus wager;

d. three of a kind is paid a value forty times said bonus wager;

e. a straight flush is paid a value fifty times said bonus wager;

f. said player's said first card and said second card are both red aces and said bonus card is a black ace is paid a value two hundred times said bonus wager.

4. The method of playing a card game of claim 1, where said progressive bonus payment table is:

a. said player's first and second card are both red aces, and said bonus card and said progressive bonus card are both black aces is paid 100% of the progressive jackpot;

b. said player's first and second card, said bonus card, and said progressive bonus card are all of the same rank is paid 10% of the progressive jackpot;

c. said player's first and second card, in any combination with the bonus card, and progressive bonus card, are all of the same suit and in sequence is paid $500.

5. The method of playing a card game of claim 2, where said bonus payment table is:

a. a pair is paid a value equal to said bonus wager;

b. a flush is paid a value three times said bonus wager;

c. a straight is paid a value five times said bonus wager;

d. three of a kind is paid a value forty times said bonus wager;

e. a straight flush is paid a value fifty times said bonus wager; and, f. said player's said first card and said second card are both red aces and said bonus card is a black ace is paid a value two hundred times said bonus wager.

6. The method of playing a card game of claim 2, where said progressive bonus payment table is:

a. said player's first and second card are both red aces, and said bonus card and said progressive bonus card are both black aces is paid 100% of the progressive jackpot;

b. said player's first and second card, said bonus card, and said progressive bonus card are all of the same rank is paid 10% of the progressive jackpot;

c. said player's first and second card, in any combination with the bonus card, and progressive bonus card, are all of the same suit and in sequence is paid $500.

7. The method of playing a card game of claim 1 where said dealer deals from a standard fifty-two card deck of playing cards having four suits, each suit having thirteen cards having, in an order from low to high, a value of 2, 3, 4, 5, 6, 7, 8, 9, 10, jack, queen, king, and ace.

8. The method of playing a card game of claim 1 where said game is played using an actual deck of cards.

9. The method of playing a card game of claim 1 where said game is played electronically.

10. The method of playing a card game of claim 1 where said challenge ante wager is set at a value of between said ante wager and 1.5 times said ante wager.

11. The method of playing a card game of claim 1 where said challenge ante wager has a value equal to said ante wager.

12. A method of playing a card game, comprising:

a. at least one player making an ante wager and a bonus wager and, if desired, an optional progressive bonus wager to initiate a game;

b. a dealer sequentially dealing the at least one player and the dealer a first card and a second card;

c. the dealer dealing a bonus card and a progressive bonus card;

d. the at least one player viewing that player's first card and second card;

e. the at least one player deciding whether to challenge the dealer, the at least one player making a challenge ante wager if the at least one player decides to challenge the dealer;

f. the dealer revealing the bonus card to the at least one player if the bonus card was dealt face down;

g. the dealer paying the at least one player if that player's first card and second card and the bonus card meet a bonus combination specified on a bonus payment table and the dealer taking the bonus wager of the at least one player if that player's first card and second card and the bonus card do not meet the bonus combination specified on the bonus payment table;

h. the dealer revealing the progressive bonus card to the at least one player if the progressive bonus card was dealt face down;

i. the dealer paying the at least one player if that player made a progressive bonus wager and that player's first card, second card, bonus card and the progressive bonus card meet a progressive bonus combination specified on a progressive bonus payment table and the dealer taking the progressive bonus wager of the at least one player if that player's first card, second card, bonus card, and the progressive bonus card do not meet the progressive bonus combination specified on the progressive bonus payment table;

j. the dealer taking the ante wager of the at least one player not making the challenge ante wager;

k. the dealer revealing the dealer's first card and second card;

l. the dealer replacing one of the dealer's first card and second card having a lowest face value if one of the dealer's first card and second card is not a jack, a queen, a king, or an ace or if the dealer's first card and second card are not cards of the same face value; the dealer now having a dealer two card hand;

m. the dealer paying the at least one player on the ante wager and on the challenge ante wager if that player's two card hand is a better poker hand than the dealer two card hand, the dealer taking the ante wager and the challenge ante wager of the at least one player if the dealer two card hand is a better poker hand than the player's two card hand, the at least one player keeping the ante wager and the challenge ante wager if the dealer two card hand and the player's two card hand are poker hands of the same value.

13. The method of playing a card game of claim 12, where, in the step of said dealer paying said at least one player on said ante wager and on said challenge ante wager if that said player's two card hand is a better poker hand than said dealer two card hand, said ante wager is paid a value equal to said ante wager and said challenge ante wager is paid a value equal to said challenge ante wager unless said player's two card hand is a pair, in which case, said challenge ante wager is paid a value twice said challenge ante wager.

14. The method of playing a card game of claim 12, where said bonus payment table is:

a. a pair is paid a value equal to said bonus wager;

b. a flush is paid a value three times said bonus wager;

c. a straight is paid a value five times said bonus wager;

d. three of a kind is paid a value forty times said bonus wager;

e. a straight flush is paid a value fifty times said bonus wager; and, f. said player's said first card and said second card are both red aces and said bonus card is a black ace is paid a value two hundred times said bonus wager.

15. The method of playing a card game of claim 12, where said progressive bonus payment table is:

a. said player's first and second card are both red aces, and said bonus card and said progressive bonus card are both black aces is paid 100% of the progressive jackpot;

b. said player's first and second card, said bonus card, and said progressive bonus card are all of the same rank is paid 10% of the progressive jackpot;

c. said player's first and second card, in any combination with the bonus card, and progressive bonus card, are all of the same suit and in sequence is paid $500.

16. The method of playing a card game of claim 13, where said bonus payment table is:

a. a pair is paid a value equal to said bonus wager;

b. a flush is paid a value three times said bonus wager;

c. a straight is paid a value five times said bonus wager;

d. three of a kind is paid a value forty times said bonus wager;

e. a straight flush is paid a value fifty times said bonus wager; and, f. said player's said first card and said second card are both red aces and said bonus card is a black ace is paid a value two hundred times said bonus wager.

17. The method of playing a card game of claim 13, where said progressive bonus payment table is:

a. said player's first and second card are both red aces, and said bonus card and said progressive bonus card are both black aces is paid 100% of the progressive jackpot;

b. said player's first and second card, said bonus card, and said progressive bonus card are all of the same rank is paid 10% of the progressive jackpot;

c. said player's first and second card, in any combination with the bonus card, and progressive bonus card, are all of the same suit and in sequence is paid $500.

18. The method of playing a card game of claim 12 where said dealer deals from a standard fifty-two card deck of playing cards having four suits, each suit having thirteen cards having, in an order from low to high, a value of 2, 3, 4, 5, 6, 7, 8, 9, 10, jack, queen, king, and ace.

19. The method of playing a card game of claim 12 where said game is played using an actual deck of cards.

20. The method of playing a card game of claim 12 where said game is played electronically.

21. The method of playing a card game of claim 12 where said challenge ante wager is set at a value of between said ante wager and 1.5 times said ante wager.

22. The method of playing a card game of claim 12 where said challenge ante wager has a value equal to said ante wager.

* * * * *